United States Patent [19]

Parsons et al.

[11] Patent Number: 4,975,683

[45] Date of Patent: Dec. 4, 1990

[54] COSMIC RADIATION FAULT DETECTION SYSTEM

[75] Inventors: Michael L. Parsons, San Dimas; Peter L. Hutchins, Roland Heights; Yeong-Jeng V. Tseng, Phillips Ranch, all of Calif.

[73] Assignee: Pacific Scientific Company, Duarte, Calif.

[21] Appl. No.: 376,766

[22] Filed: Jul. 7, 1989

[51] Int. Cl.[5] ..... G08B 17/12

[52] U.S. Cl. ..... 340/578; 431/24

[58] Field of Search ..... 340/578, 825.65; 250/554; 356/227; 431/24

[56] References Cited

U.S. PATENT DOCUMENTS 4,328,527 5/1982 Landis ..... 340/578 X 4,823,114 4/1989 Gotisar ..... 340/578

*Primary Examiner*—Joseph A. Orsino

*Assistant Examiner*—Thomas J. Mullen, Jr.

*Attorney, Agent, or Firm*—Knobbe, Martens, Olson & Bear

[57] ABSTRACT

An optical fire detection system that uses cosmic radiation or a radioactive source to test whether the ultraviolet light detector tube operates properly and includes self test logic to independently verify that the detector electronics are functioning properly. A high voltage is applied across the ultraviolet light detector tube to produce pulses of current when radiation is present. A pulse rate discriminator circuit measures the current pulses and outputs a fire signal if the pulse rate is equal to or greater than the pulse rate produced by ultraviolet radiation from a fire. A background count circuit also measures the current pulses from the ultraviolet light detector tube to test whether the ultraviolet light detector tube is operational. At least one current pulse should be detected within a specified time because the detector tube senses cosmic radiation or radiation from the radioactive source. If no current pulse is received by the background detector circuit within the specified time, the background count circuit signals that the detector tube or high voltage supply is defective.

7 Claims, 3 Drawing Sheets

COSMIC RADIATION FAULT DETECTION SYSTEM

BACKGROUND OF THE INVENTION

1. Field of the Invention

This invention relates generally to a method and system is functioning properly. In particular, the present invention relates to optical fire detection systems wherein ultraviolet light detector tubes are used as sensors to detect the presence of fire.

2. Description of the Related Art

Fires produce radiation that can be detected by ultraviolet light detector tubes. Ultraviolet light detector tubes are often used as sensors in optical fire detection systems for aircraft and other vehicles. Typically, a high voltage potential is applied to the ultraviolet light detector tube. When ultraviolet radiation hits the detector tube, the radiation generates current pulses at the cathode of the detector tube. The rate of the current pulses increases as the intensity of the radiation increases. Circuits can be constructed to measure the radiation detected and determine if the radiation has reached a level equal to the level of ultraviolet radiation present with a fire.

Fire detection systems using ultraviolet light detector tubes generally require that the detector tubes be tested to insure the system is fully functional. However, in most applications detector tubes cannot be tested by simple electrical means because they exhibit nearly infinite resistance when they are not detecting ultraviolet light. When ultraviolet light is not present, a high voltage potential (1100 volts or more) must be placed across the detector tube to test it. One method known in the art for testing detector tubes is the use of an ultraviolet light emitter. An ultraviolet light emitter is a lamp that produces ultraviolet radiation when activated. To test whether the detector tube operates properly, an ultraviolet light emission lamp is permanently placed next to the detector tube. During a self test the emission lamp is activated to emit ultraviolet radiation that should trigger an alarm signal if the system is working properly If the fire detection system does not respond with a signal indicating a fire, then either the detector tube or the detector electronics are defective.

While emitter lamps provide a method to test whether a detector tube functions properly, there are several disadvantages with using emitter lamps. First, emitter lamps add to the cost and size of fire detection systems. The cost and size are increased by having to add the emitter lamps themselves. Each detector tube in the system requires an emitter lamp located adjacent to the detector tube for testing purposes The detector tubes are commonly placed in several locations. Placing emitter lamps next to each ultraviolet light detector tube doubles the wiring requirements. Second, the activation of the emitter lamps requires additional power. In addition to the high voltage potential required for the detector tubes, more power is required for the emitter lamps. Third, emitter lamps tend to have reliability problems. If an emitter lamp is unreliable it puts the operational status of the entire fire detection system in question. This is a significant disadvantage since ultraviolet light emitters are more unreliable than detector tubes. A system test may indicate a defective detector tube when in fact only an emitter lamps is defective. Therefore, the use of emitter lamps adds to the cost, weight and unreliability of optical fire detection systems.

SUMMARY OF THE INVENTION

A preferred embodiment of the present invention includes an apparatus and method for testing the operational status of an optical fire detection system. The present invention uses the effects of cosmic radiation to test whether the ultraviolet light detector tubes in the fire detection system are working. Alternatively, a continuous radioactive source may be used to supply background radiation instead of relying on cosmic radiation. The present invention also includes self test logic to verify that the electronics associated with the system are working. By using cosmic radiation or a radioactive source to test detector tubes, the need for emitter lamps, and the cost associated with their use are eliminated.

In a preferred embodiment the present invention comprises an ultraviolet light detector tube, a voltage regulator, a high voltage supply, a pulse rate discriminator circuit, a background count detector circuit and self test logic. A voltage is input to the high voltage supply through the voltage regulator circuit. The high voltage supply is coupled with the ultraviolet light detector tube. The detector tube's output is connected with the background counter circuit and the pulse discriminator circuit. The pulse rate discriminator circuit outputs a signal indicating there is a fire if the number of pulses on the output of the detector tube reaches a predetermined level in a predetermined time. The background count circuit indicates whether the ultraviolet light detector tube is functioning properly. If there is at least one pulse within a specified time period then the ultraviolet light detector tube is working. There should be at least one pulse during the specified time period due to cosmic radiation or the radioactive source. If no pulse is detected within the time period, then the detector tube is defective and the background count circuit generates a fault signal. Additionally, the self test logic is included which performs an independent test of the electronic circuitry downstream from the ultraviolet light detector tube. The self test logic generates pulses designed to simulate the pulses present with a fire. If the fire signal is not asserted shortly after the test signal has been asserted then the electronics are not functioning properly.

The present invention solves the aforementioned problems encountered with present methods for testing optical fire detection systems that employ ultraviolet light detector tubes. The present invention advantageously eliminates the need for ultraviolet emitter lamps by using radiation to test whether the detector tube is functioning properly.

It is a further advantage of the present invention to provide a method and apparatus for testing ultraviolet light detector tubes that are more reliable, lighter and cheaper.

DESCRIPTION OF THE PREFERRED EMBODIMENT

Figure 1:
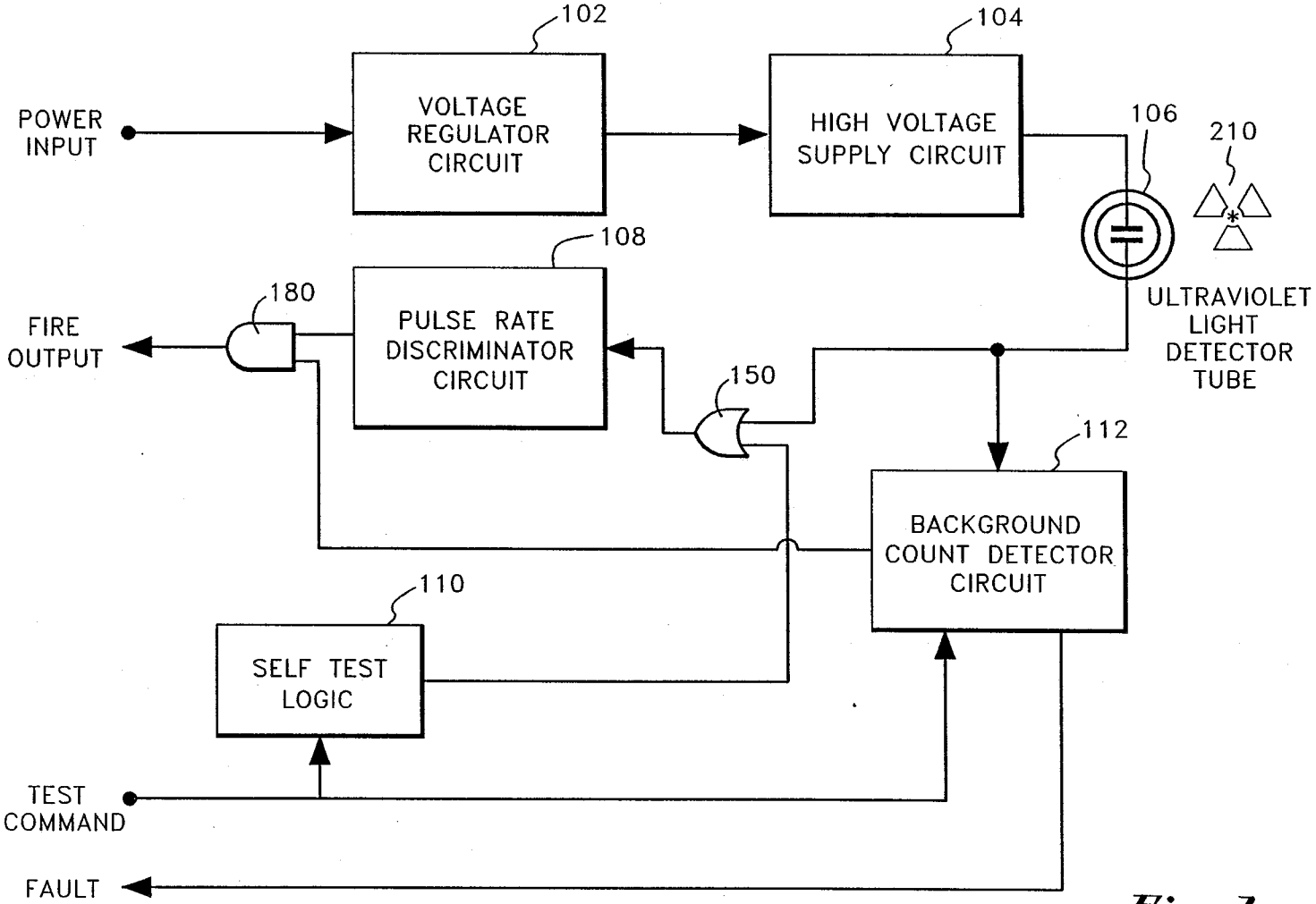
FIG. 1 a block diagram of an optical fire detection system with a preferred embodiment of the present invention.

The optical fire detection system of the present invention is illustrated in the block diagram of FIG. 1. In a preferred embodiment, the fire detection system of the present invention comprises a voltage regulator circuit 102, a high voltage supply circuit 104, an ultraviolet light detector tube 106, a pulse rate discriminator circuit 108, self test logic circuit 110 and a background count detector circuit 112.

The present invention utilizes the ultraviolet light detector tube 106 as a sensor for a fire. The voltage regulator circuit 102 and the high voltage supply circuit 104 provide a high voltage that is applied to the ultraviolet light detector tube 106. The ultraviolet light detector tube 106 produces pulses on its cathode when ultraviolet radiation is detected. The pulses are input into the pulse rate discriminator circuit 108 to determine if the measured radiation level is equal to the radiation level produced by a fire. If the measured radiation level reaches the radiation level of a fire, the pulse rate discriminator circuit 108 outputs a FIRE DETECT signal. The pulses from the detector tube 106 are also sent to the background count detector circuit 112 which uses the pulses to determine whether the ultraviolet light detector tube 106 is operational. The self test logic circuit 110 initiates and performs a test of whether the pulse rate discriminator circuit 108 is working properly.

Figure 2:
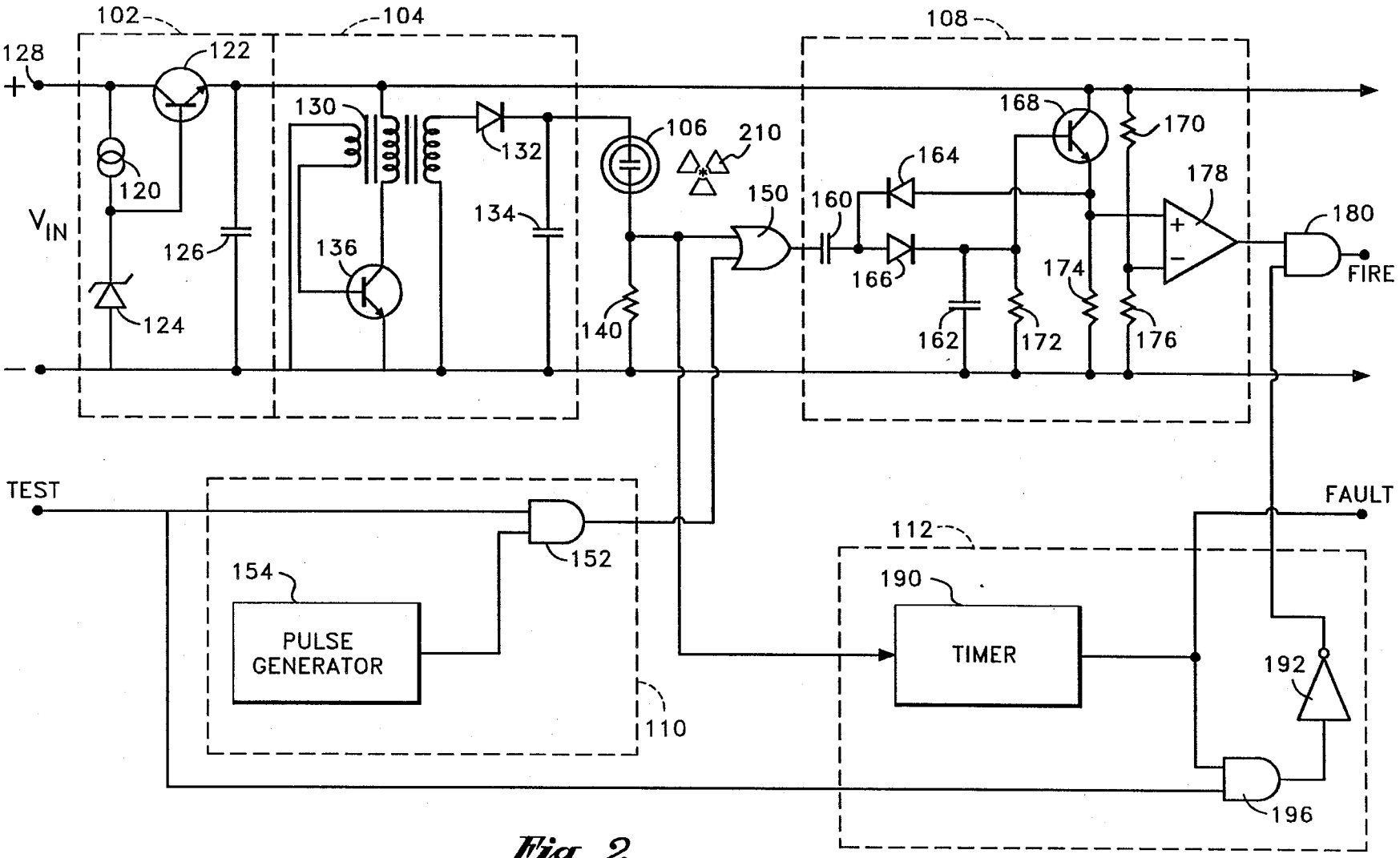
FIG. 2 illustrates a schematic diagram of a optical fire detection system with a preferred embodiment of the fault of the present invention.

Power is first applied to the voltage regulator circuit 102 as illustrated in FIG. 2. The voltage regulator circuit 102 is connected in series between the power input on lead 128 and the high voltage supply circuit 104. The voltage regulator circuit 102 comprises a current source 120, a transistor 122, a zener diode 124 and a capacitor 126. The input power on lead 128 is coupled with the current source 120 and the collector of the transistor 122. The other end of the current source 120 is connected to the base of the transistor 122 and the cathode of the zener diode 124. The anode of the zener diode 124 is connected to ground. The regulated output voltage is provided from the emitter of the transistor 122 which is coupled to the capacitor 126. The other end of the capacitor 126 is connected to ground.

The voltage regulator circuit 102 is designed to maintain a constant output voltage irrespective of fluctuations in the input voltage. The zener diode 124 provides a reference voltage for the transistor 122. The transistor 122 is connected in a common-collector configuration for current amplification with a unity voltage gain. The transistor 122 compensates for fluctuations in the input voltage. Finally, the regulated voltage is smoothed by the capacitor 126 and output at the emitter of the transistor 122.

The high voltage supply circuit 104 receives the regulated voltage, amplifies it and the applies it across the ultraviolet light detector tube 106 cathode. The high voltage supply circuit 104 comprises a step up transformer 130, a diode 132, a capacitor 134 and a transistor 136. These components are interconnected as a fly back converter. The regulated voltage is connected to one lead of the primary of the step up transformer 130. The other lead of the primary of the step up transformer 130 is connected to the collector of the transistor 136. The emitter of the transistor 136 is connected to ground, and the base of the transistor 136 is connected to ground through a control winding of the transformer 130. The transistor 136 and the transformer 130 act as a self-oscillating circuit that produces high voltage AC. The secondary of the transformer 130 provides high voltage AC to anode of the diode 132. The diode 132 rectifies the AC voltage into high voltage DC. The cathode of the diode 132 is also connected to the capacitor 134 with the other lead of the capacitor 134 being connected to ground. The capacitor 134 smooths the DC voltage provided by the diode 132 and the voltage provided at the anode of the diode 132 is in the range of 300 to 600 volts DC.

The voltage provided by the high voltage supply circuit 104 is placed across the ultraviolet light detector tube 106 by connecting the cathode of the diode 132 to the anode of the ultraviolet light detector tube 106. The cathode of the detector tube 106 is pulled to ground through a resistor 140. In the preferred embodiment, the detector tube 106 is advantageously the solar blind Hamamatsu R1753-01 ultraviolet light detector tube. The ultraviolet light detector tube 106 is designed to be less sensitive to sunlight (solar blind).

The high voltage placed between the anode and cathode of the ultraviolet light detector tube 106 permits the measurement of ultraviolet or gamma radiation. Ultraviolet or gamma radiation striking the cathode of the detector tube 106 will create an electron and consequential ion pairs within the detector tube 106. The ion pair consists of a positive molecule and an electron. The electron will be accelerated toward the anode and the positive molecule toward the cathode because of the 300 to 600 volt potential across the detector tube 106. As the electron is accelerated it causes a chain reaction effect as it collides with other molecules in the detector tube 106. The result is a pulse of current at the cathode of the detector tube 106. The operation of the ultraviolet light detector tube 106 depends on a photon hitting the cathode with enough energy to eject an electron which is accelerated towards the anode and produces a current pulse.

As illustrated in FIG. 2, the cathode of the detector tube 106 is connected to the pulse rate discriminator circuit 108 through an OR-gate 150. The cathode of the ultraviolet light detector tube 106 is connected to one input of the OR-gate 150. The other input of the OR-gate 150 is connected to the output of the self test logic circuit 110. The output of the OR-gate 150 is then provided as the input signal for the pulse rate discriminator circuit 108. The OR-gate 150 allows the pulse rate discriminator circuit 108 to be triggered either by current pulses output by the ultraviolet light detector tube 106 indicating the presence of a fire, or by current pulses produced by the self test logic circuit 1!0 designed to simulate the pulses produced by a fire.

The self test logic circuit 110 performs a test of the electronics downstream from the ultraviolet light detector tube 106 that is independent from the test of ultraviolet light detector tube 106. In particular, the self test logic circuit 110 provides current pulses to test if the pulse rate discriminator circuit 108 is working properly. The self test logic circuit 110 comprises an AND-gate 152 and a pulse generator 154. The self test logic circuit 110 receives a TEST signal and outputs pulses to simulate the presence of a fire. The self test logic circuit 110 receives the TEST signal which is input to the AND-gate 152. The output of the pulse generator 154 is connected to the other input of the AND-gate 152. The pulse generator 154 outputs pulses designed to simulate the pulses that the ultraviolet light detector tube 106 would output if there was a fire. The output of the pulse generator 154 is sent to the pulse rate discriminator circuit 108, but may be inhibited by the AND-gate 152. The AND-gate 152 allows the pulses to be sent to the pulse rate discriminator circuit 108 only when the TEST signal is asserted.

The pulse rate discriminator circuit 108 measures the number of pulses and asserts a FIRE DETECT signal if the number of pulses is greater than the number of pulses that the ultraviolet light detector tube 106 would emit if a fire were present. From the OR-gate 150, pulses are connected to one end of a first capacitor 160. The other end of the first capacitor 160 is connected to the cathode of a first diode 164. The anode of the first diode 164 is coupled to the emitter of a transistor 168, one end of a resistor 174 and the positive input of a comparator 178. The other end of the resistor 174 is connected to ground. The first capacitor 160 is also connected to the anode of a second diode 166 The cathode of the second diode 166 is connected to a second capacitor 162, a second resistor 172 and the base of the transistor 168. The other end of the second capacitor 162 and the second resistor 172 are both connected to ground. The collector of the transistor 168 is connected to the positive supply voltage. The negative input of the comparator 178 is connected to a reference voltage derived from the regulated supply voltage through a resistor 170 and a resistor 176. The output of the comparator 178 is coupled to an AND-gate 180 along with the inverted output of the background count detector circuit 112. The output of the AND-gate 180 provides the FIRE DETECT signal.

The pulse rate discriminator circuit 108 measures the pulses produced by the ultraviolet light detector tube 106 and outputs a FIRE DETECT signal if the number of pulses is more than the minimum pulses produced by a fire. The output of the OR-gate 150 is normally low and goes high when a pulse is detected. Initially, there is no charge on the first capacitor 160. When the first pulse occurs, the output of the OR-gate 150 goes high and charges the first capacitor 160. During the charging of the first capacitor 160, the second diode 166 will be forward biased to transfer an equal charge to the second capacitor 162. The second capacitor 162 has a capacitance ten times greater than that of the first capacitor 160. Thus, 10 successive pulses charging the first capacitor 160 are required to charge the second capacitor 162. The transistor 168 and the diode 164 increase the initial charge on capacitor 160 to keep the increment of charge the same for successive pulses. Thus, each pulse increases the amount of charge on the second capacitor 162 until the second capacitor 162 is fully charged. When the second capacitor 162 is charged to a voltage equal or greater than the comparator reference voltage, it will trigger the FIRE DETECT signal. The resistor 172 is also connected in parallel with the second capacitor 162 to leak charge from the second capacitor 162. The resistor 172 assures that the number of pulses required to charge the second capacitor 162 are detected within a particular time period (i.e., the voltage on capacitor 162 proportional to the pulse rate).

Figure 3:
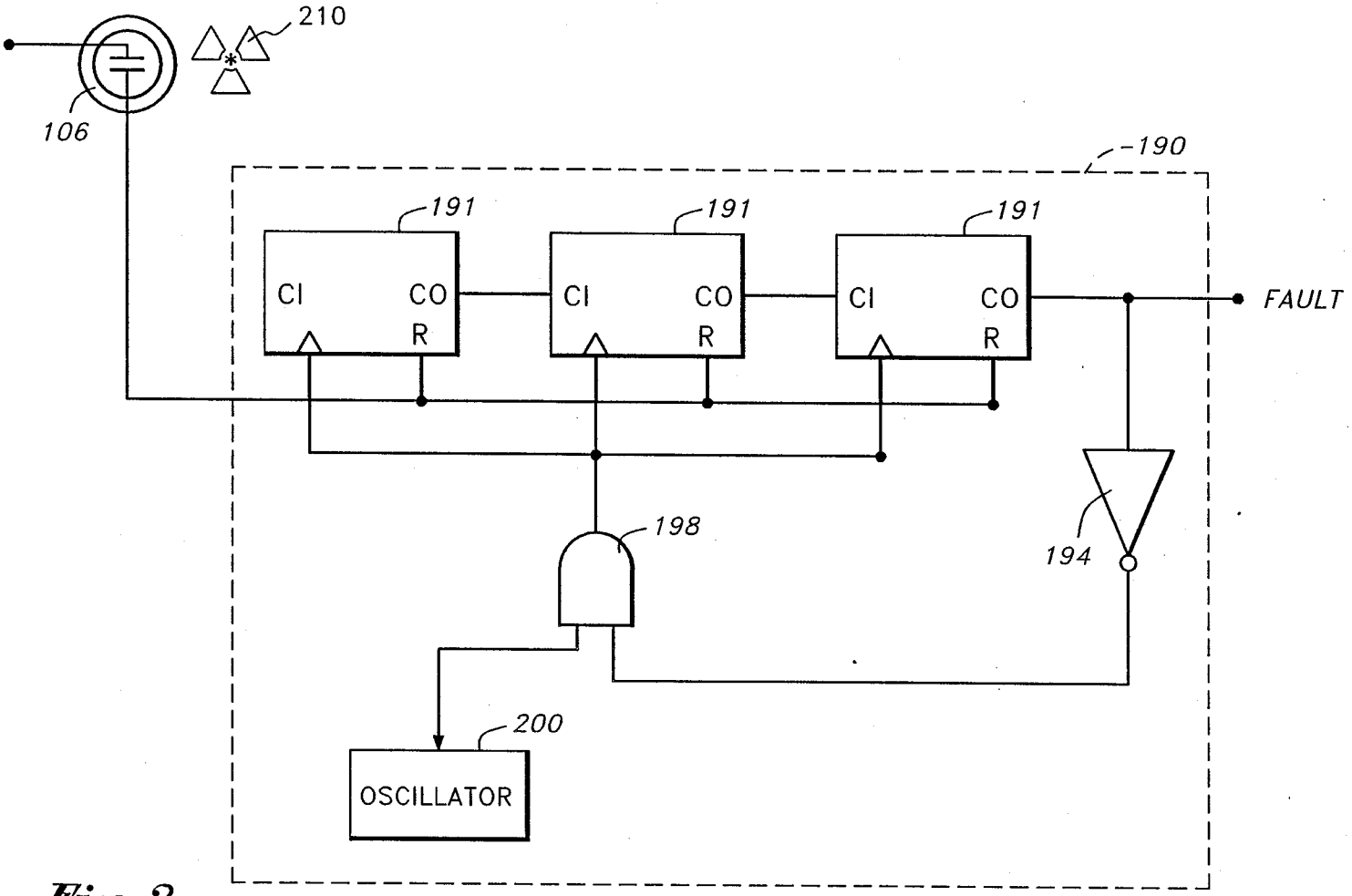
FIG. 3 illustrates a detailed schematic diagram of the background count detector circuit of the present invention.

The final circuit is the background count detector circuit 112, as illustrated in FIG. 2, and more particularly, in FIG. 3. The background count detector circuit 112 uses cosmic radiation to test whether the ultraviolet light detector tube 106 works. Cosmic radiation refers to the high energy subatomic particles that impinge the earth uniformly from all directions. Cosmic rays are comprised principally of hydrogen and helium atoms with the orbital electrons completely stripped off. Certain particles in cosmic radiation have enough high energy levels to create a pulse on the cathode of the ultraviolet light tube 106. In an exemplary application, the cosmic radiation constantly hitting the earth should trigger at least one pulse on the detector tube 106 within 40 minutes of the last pulse. The time period may vary depending on the type of detector tube used. The present invention advantageously uses this fact to test whether the ultraviolet light tube 106 is working.

Instead of relying on cosmic radiation, an alternate embodiment of the present invention may also comprise a radioactive source 210 to supply background radiation. In an exemplary embodiment, the radioactive source 210 would be any continuous low level source of gamma radiation. Gamma rays are sufficient to cause a pulse on the cathode of the ultraviolet light detector tube 106. Thus, a radioactive source 210 may be attached to the ultraviolet light detector tube 106 to provide the background radiation necessary to verify that the ultraviolet light detector tubes 106 are working. The radioactive source 210 advantageously overcomes the problems associated with the use of ultraviolet light emitter lamps. The radioactive source 210 does not require the power or wiring and is much more reliable than emitter lamps.

Referring now to FIG. 2, the background count detector circuit 112 comprises a timer 190, an inverter 192, and an AND-gate 196. The background count detection circuit 112 receives the current pulses from the ultraviolet light detector tube 106. Referring to FIG. 3, the timer 190 may be comprised of a series of cascaded counters 191, an inverter 194, an AND-gate 198 and an oscillator 200. It should be understood that while the timer 190 is described as a counter, in an exemplary embodiment the timer 190 is a MC14541B oscillator/-timer made by Motorola set to run at about 13.6 hz. The cathode of the detector tube 106 is connected to the reset of the counters 191. The counters 191 advantageously have an synchronous clear so that regardless of when the current pulses from the detector tube 106 are received the counters 191 will be reset. The counters 191 are cascaded by coupling the output of the previous counter into the input of the next counter. The output of the most significant counter 191 is input to the inverter 194. The output of the inverter 194 is coupled with one input of the second AND-gate 198. The other input of the AND-Gate 198 is coupled with the output of the oscillator 200. The output of the second AND-gate 198 is connected to the clock input of the counters 191. The carry out of the most significant counter 191 is also input to the first AND-gate 196. The other input of the first AND-gate 196 is coupled with the TEST signal. The output of the AND-gate 196 is connected with the inverter 192, and the output of the inverter 192 is provided as an input to the AND-gate 180 of the pulse rate discriminator circuit 108.

The background count detector circuit 112 is essentially a timer that is reset to zero if there is a pulse on the cathode of the ultraviolet light detector tube 106 Since the pulse may occur anytime and has a limited duration the cascaded counters 191 have an synchronous clear. If there has been no pulse on the cathode of the ultraviolet light detector tube 106 by a specified time then a fault signal (the assertion of the most significant Q output of the counters 191) is asserted to indicate that the detector tube is not functioning properly The fault signal also provides feedback and inhibits the oscillator 200 from sending a clock to the counters 191. In a preferred embodiment, the background count detector circuit 112 will assert a fault signal if there has not been a current pulse from the detector tube 106 within 40 minutes of the last current pulse. This time period may vary depending on the type of tube used. The oscillator rate and the number of counters 191 are selected such that the counters 191 will have counted so that the chosen Q output is asserted after 40 minutes. Once 40 minutes has elapsed without a pulse on the cathode of the detector tube 106 the FIRE DETECT signal will be inhibited if a TEST signal occurs since the assertion of the Q output of the counters 191 and a TEST signal will provide a logical zero on the output of the inverter 192 in turn inhibiting the AND-gates 196, 180 from asserting the FIRE DETECT signal. In an alternate embodiment, the Q output of the counters 191 may be connected to an LED or some other indicating device to alert the user that the detector tube 106 is not functioning properly It should be appreciated that while the preferred embodiment of the background counter detector circuit 112 is constructed using counters, the timer may be also constructed of using the clock of a microprocessor or any other equivalent circuit that may be use to assert a signal after a specified period of time if not reset.

Having described the invention in connection with certain preferred embodiments thereof, it will be understood that many modifications and variations thereto are possible, all of which fall within the true spirit and scope of this invention.

What is claimed is:

1. A device for detecting fire by measuring ultraviolet radiation, comprising:

a voltage regulating circuit;

at least one ultraviolet light detector tube connected to said voltage regulating circuit, and producing pulses of current when ultraviolet light hits said ultraviolet light detector tube;

a pulse rate discriminator circuit connected to receive said pulses of current from said ultraviolet light detector tube, said discriminator circuit outputting a signal to trigger an alarm if the number of current pulses detected by said pulse rate discriminator circuit is greater than a predetermined level within a specified time; and a background detector circuit connected to receive pulses of current from said ultraviolet light detector tube, said detector circuit monitoring the output of said ultraviolet light detector tube simultaneously with operation of said pulse rate discriminator circuit, said detector circuit outputting a fault signal to indicate that said ultraviolet light tube is not working if no pulses are received within a predetermined time period.

2. A device for detecting fire by measuring radiation, comprising:

a voltage supply circuit;

at least one detector tube connected to said voltage supply for producing pulses in response to radiation;

a pulse rate discriminator circuit connected to receive said pulses from said detector tube, said discriminator generating a signal to trigger an alarm if said pulses exceed a first predetermined rate; and a background detector circuit connected to receive said pulses produced by background radiation from said detector tube, said detector circuit continuously monitoring the output of said ultraviolet light detector tube, said detector generating a fault signal to indicate that said detector tube is not working if said pulses do not exceed a second rate, lower than said first rate.

3. The device, as defined in claim 2, additionally comprising a self-test circuit that receives a test signal and outputs a series of pulses to said pulse rate discriminator circuit, said series of pulses selected to simulate the pulses created by said ultraviolet light detector tube in the presence of fire.

4. The device, as defined in claim 2, wherein said background detector circuit comprises:

an oscillator for generating a clock signal; and a counter that counts the pulses of said clock signal, said counter connected to be reset by said pulses provided by said ultraviolet light detector tube, said counter providing an output if a predetermined number of clock pulses occur without said counter being reset.

5. The device as defined in claim 2, wherein the background detector circuit comprises a timer that is reset by said pulses from said ultraviolet light detector tube, said timer outputting said fault signal after a predetermined time has elapsed without the occurrence of at least one of said pulses from said ultraviolet light detector tube.

6. A device for detecting fire by measuring radiation, comprising:

a voltage supply circuit;

at least one detector tube connected to said voltage supply for producing pulses in response to radiation;

a pulse rate discriminator circuit connected to receive said pulses from said detector tube, said discriminator generating a signal to trigger an alarm if said pulses exceed a first predetermined rate;

a background detector circuit connected to receive said pulses produced by background radiation from said detector tube, said detector circuit continuously monitoring the output of said ultraviolet light detector tube, said detector generating a fault signal to indicate that said detector tube is not working if said pulses do not exceed a second rate, lower than said first rate; and a radioactive source attached near said detector tube, said radioactive source producing radiation sufficient to produce pulses exceeding said second rate and less than said first rate.

7. A method for testing whether a fire sensing light detector is functional, comprising the steps of:

applying a voltage to said light detector tube;

measuring the electronic pulses produced by said light detector tube;

monitoring the output of said detector tube simultaneously with said measurement of said electronic pulses produced by said light detector tube; and outputting a fault signal if the background radiation does not produce electronic pulses from said light detector tube at a predetermined rate.

* * * * *